US006368156B1

(12) United States Patent
Lin

(10) Patent No.: US 6,368,156 B1
(45) Date of Patent: Apr. 9, 2002

(54) AUDIO JACK CONVENIENTLY AND RELIABLY MOUNTED ON A CIRCUIT BOARD

(75) Inventor: Yi Sheng Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,494

(22) Filed: Dec. 27, 2000

(51) Int. Cl.[7] ..... H01R 24/04
(52) U.S. Cl. ..... 439/668; 439/188
(58) Field of Search ..... 439/668, 669, 439/188

(56) References Cited

U.S. PATENT DOCUMENTS 5,338,215 A * 8/1994 Lee et al. ..... 439/668
5,919,052 A * 7/1999 Ho ..... 439/668
6,056,602 A * 5/2000 Wu ..... 439/668
6,077,126 A * 6/2000 Peng ..... 439/668

* cited by examiner

*Primary Examiner*—Gary Paumen
(74) *Attorney, Agent, or Firm*—Wei Te Chung

(57) ABSTRACT

An audio jack designed to be wedged between a printed circuit board and a fixed portion of an electronic device in which it is mounted, thereby obviating the need to solder contacts thereof to the printed circuit board. The audio jack includes a housing (1) and a plurality of contacts received in the housing. The housing defines a longitudinal plug-insertion hole (12) therethrough for receiving a mating plug. Each contact (3, 4, 5, 6) includes a base (30, 40, 50, 60) and a tail portion (32, 41, 51, 61). Each tail portion extends downwardly and inwardly from a bottom of the base. A contact tab (321, 411, 511, 611) is formed on a distal end of each tail portion for resiliently abutting against circuit traces of a printed circuit board.

1 Claim, 5 Drawing Sheets

AUDIO JACK CONVENIENTLY AND RELIABLY MOUNTED ON A CIRCUIT BOARD

FIELD OF THE INVENTION

The present invention relates to the art of electrical connectors and, particularly, to an audio jack for conveniently and reliably mounting on a printed circuit board.

BACKGROUND OF THE INVENTION

A jack normally includes an insulative housing and a plurality of terminals mounted in the housing. Each terminal usually has a contact portion for contacting a mating connector (e.g. a plug) and a mounting portion for securing the audio jack to an electronic device.

Such a conventional audio jack is disclosed in U.S. Pat. No. 5,919,052. In this prior art patent, a jack includes a plurality of terminals mounted in a casing. Each terminal has a contact portion and a flat mourting portion generally perpendicular to the contact portion. The mounting portion is maintained flush with a bottom cover plate for surface mounting on a printed circuit board. However, small distances between terminals are required in miniature electronic devices to minimize the overall sizes thereof. During a surface mounting process, unwanted solder bridges between adjacent mounting portions are prone to occur, resulting in short circuits. Furthermore, the surface-mounting method is troublesome and requires a high temperature, which tends to distort the printed circuit board.

This invention is directed to an improved audio jack having a locking means for resiliently abutting against circuit traces of a printed circuit board, which obviates distortion of the printed circuit board and formation of short circuits which otherwise might occur when the audio jack is soldered to the circuit board.

SUMMARY OF THE INVENTION

A main object of the invention is to provide a new and improved audio jack for conveniently interconnecting the audio jack with a printed circuit board.

Another object of the present invention is to provide an audio jack with a controlled normal force for retaining a mating plug.

An audio jack in accordance with the present invention comprises an insulating housing and a plurality of contacts received in the housing. The housing defines a longitudinal plug-insertion hole therethrough for receiving a mating plug. Each contact includes a base and a tail portion extending downwardly and inwardly from the base. The tail portion forms a contact tab on a distal end thereof for resiliently abutting against appropriate circuit traces on a top surface of a printed circuit board.

In use, the audio jack is retained between the circuit board and a portion of the electronic device, which downwardly presses the audio jack so that the contact tabs resiliently engage the appropriate circuit traces on the top surface of the printed circuit board. In this way, the audio jack is maintained in position on the circuit board without requiring solder to fix the contacts to the circuit traces.

Other objects, advantages and novel features of the invention will become more apparent from the following detailed description when taken in conjunction with the accompanying drawings.

DETAILED DESCRIPTION OF THE INVENTION

Figure 1:
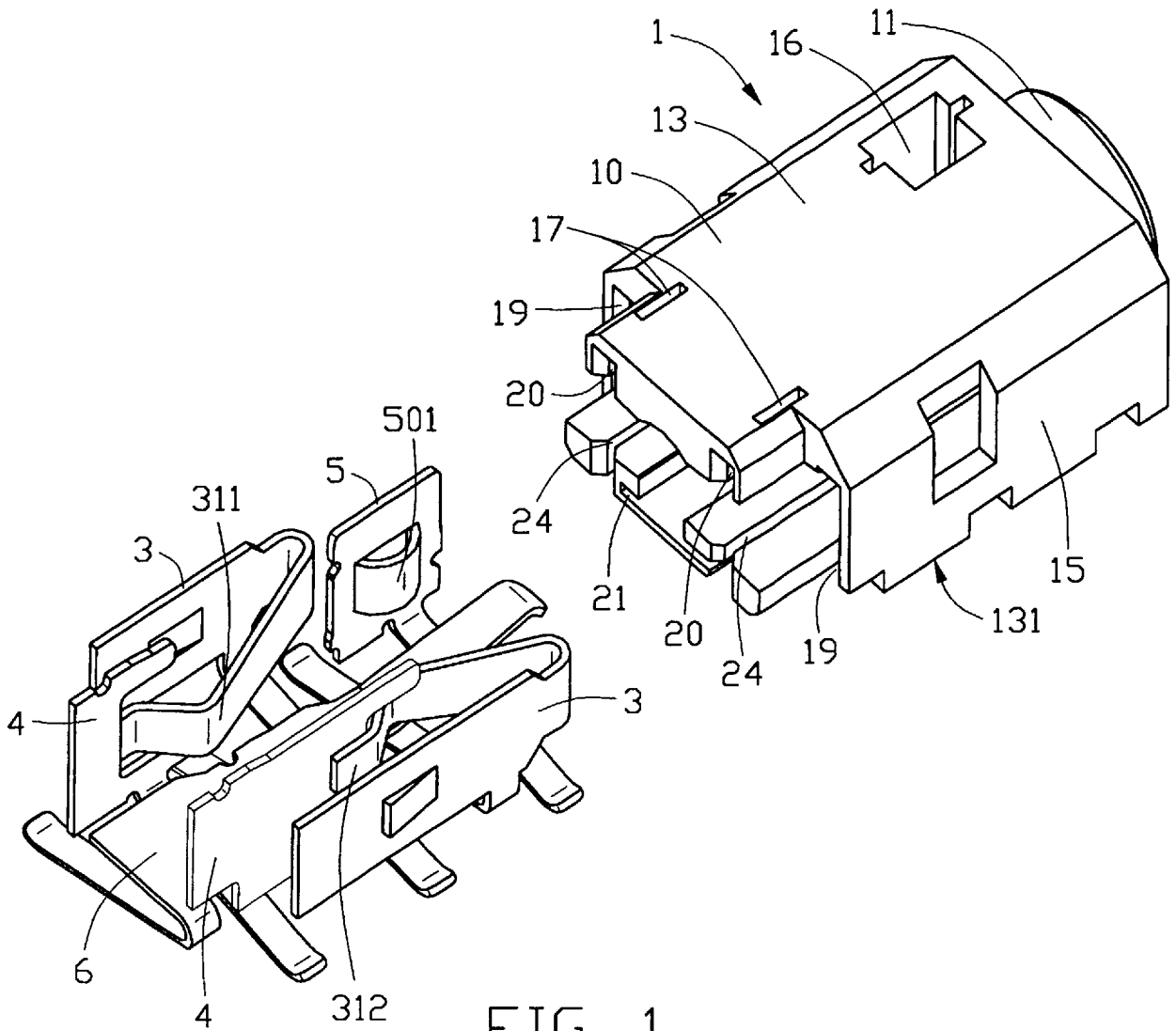
FIG. 1 is an exploded view of an audio jack of the present invention, wherein contacts of the audio jack are assembled together.

Referring to FIG. 1, an audio jack according to the present invention comprises an insulating housing 1, a pair of resilient contacts 3, a pair of switch contacts 4, a retention pad 5 and a grounding contact 6.

Figure 2:
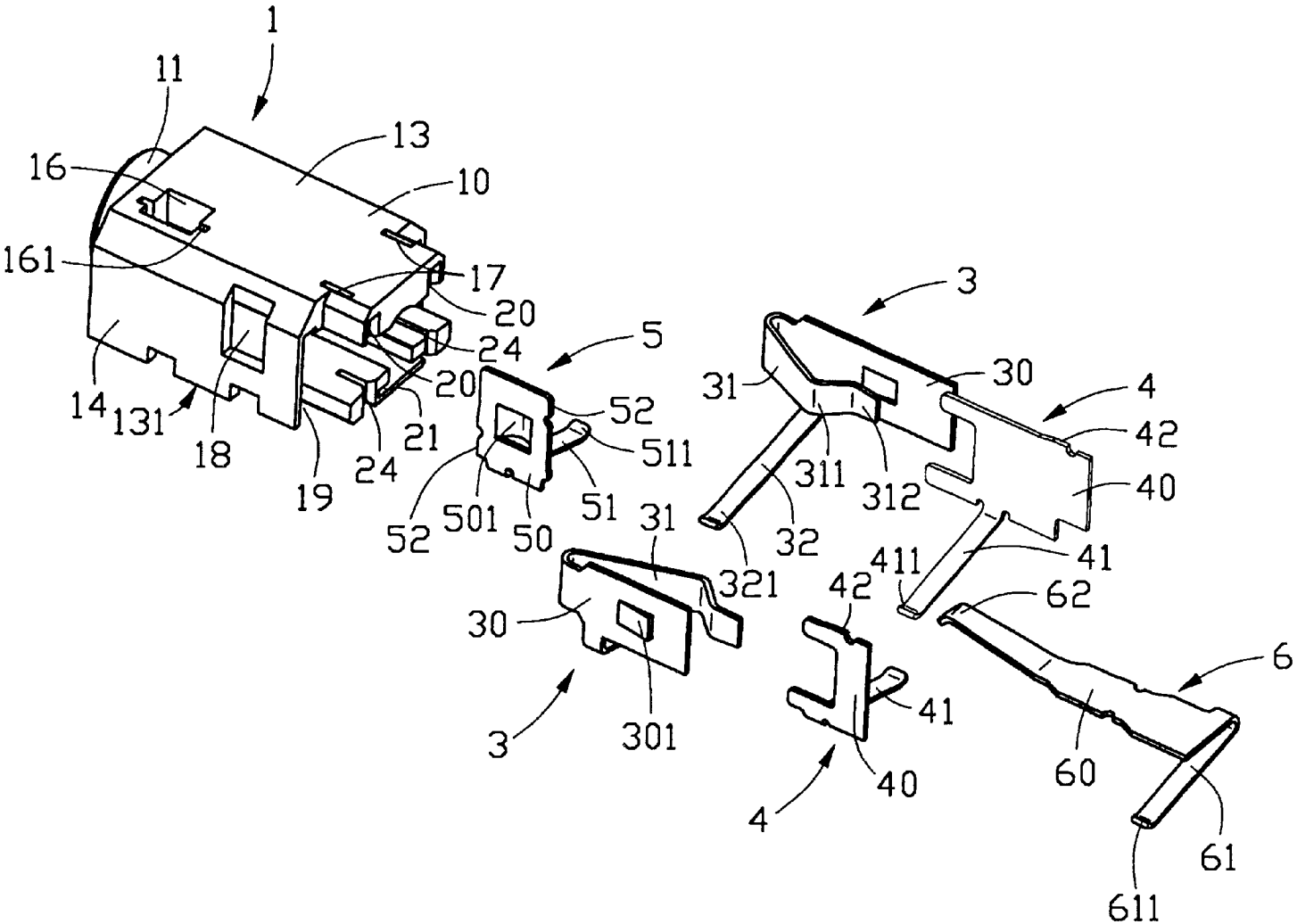
FIG. 2 is another exploded view of the present invention, particularly showing each separate contact.
Figure 4:
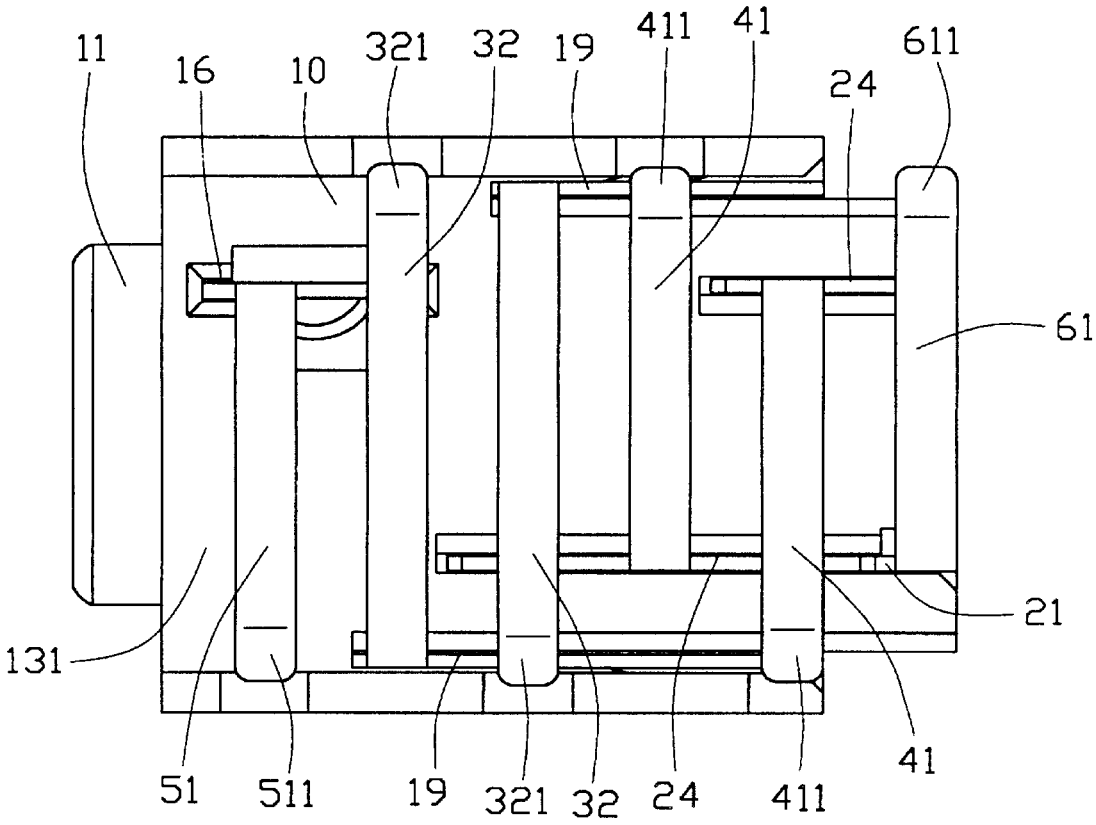
FIG. 4 is a bottom view of FIG. 3.

Referring to FIGS. 1, 2 and 4, the housing 1 includes a main body 10 and a cylindrical sleeve 11 forwardly extending from a front face of the main body 10. A plug-insertion hole 12 (cf. FIG. 5) is longitudinally defined through the main body 10 and the sleeve 11 for receiving a plug (not shown) therein.

The main body 10 has a top wall 13, a bottom 131, a first sidewall 14 and a second sidewall 15 opposite the first sidewall 14. A slot 16 is defined in the top wall 13 beside an inner side of the first sidewall 14. A pair of cutouts 161 are respectively defined in two opposite sides of the slot 16 opposing each other. A pair of narrow slits 17 are defined in the top wall 13 far from the sleeve 11. Two substantially rectangular openings 18 are respectively defined in the sidewalls 14 and 15. A pair of channels 19 are respectively longitudinally defined in the inner side of the sidewalls 14 and 15. A pair of upper notches 20 are respectively longitudinally defined in the inner side of the top wall 13 next to a corresponding channel 19. A pair of lower notches 24 are defined through the bottom 131 and are aligned with corresponding upper notches 20. A trough 21 is defined in the bottom 131 of the main body 10.

Referring to FIGS. 1 and 2, each resilient contact 3 comprises a substantially rectangular and planar base 30, a cantilevered spring contact arm 31 bending and reversely extending from an end of the base 30, and a tail portion 32 downwardly and inwardly extending from a bottom of the base 30. A substantially rectangular protrusion 301 is formed in approximately a middle of the base 30 for engaging with the opening 18 of the housing 1. The contact arms 31 each form a curve portion 311 in substantially a middle part thereof. A contact portion 312 extends from a free end of the curve portion 311 and is substantially parallel to the base 30. A contact tab 321 is formed on a distal end of the tail portion 32 for resiliently engaging an appropriate circuit trace on a top surface of a printed circuit board (not shown).

Each switch contact 4 is provided to cooperate with the contact portion 312 of a corresponding resilient contact 3. Each switch contact 4 comprises a substantially rectangular and planar base 40 and a tail portion 41 downwardly and inwardly extending from a bottom of the base 40. A barb 42 is formed on an upper side of the base 40 for securely fixing in a corresponding slit 17 of the housing 1. A contact tab 411 is formed on a distal end of the tail portion 41 for resiliently engaging an appropriate circuit trace on a top surface of the printed circuit board (not shown).

The retention pad 5 comprises a substantially rectangular and planar base 50 and a tail portion 51 downwardly and inwardly extending from a bottom of the base 50. An arcuate protrusion 501 is formed on the base 50 for biasing against a plug. The protrusion is formed in any known manner, such as by stamping or coining. The base 50 forms a pair of barbs 52 on opposite edges thereof for respectively latching with the corresponding cutouts 161 of the housing 1. A contact tab 511 is formed on a distal end of the tail portion 51 for resiliently engaging an appropriate circuit trace on the top surface of the printed circuit board.

The grounding contact 6 comprises an elongated base 60 and a tail portion 61. A contacting protrusion 62 is upwardly convex at an end of the base 60. The tail portion 61 downwardly bends and laterally extends from an opposite end of the base 60. A contact tab 611 is formed on a distal end of the tail portion 60 for resiliently engaging an appropriate circuit trace on the top surface of the printed circuit board.

Figure 3:
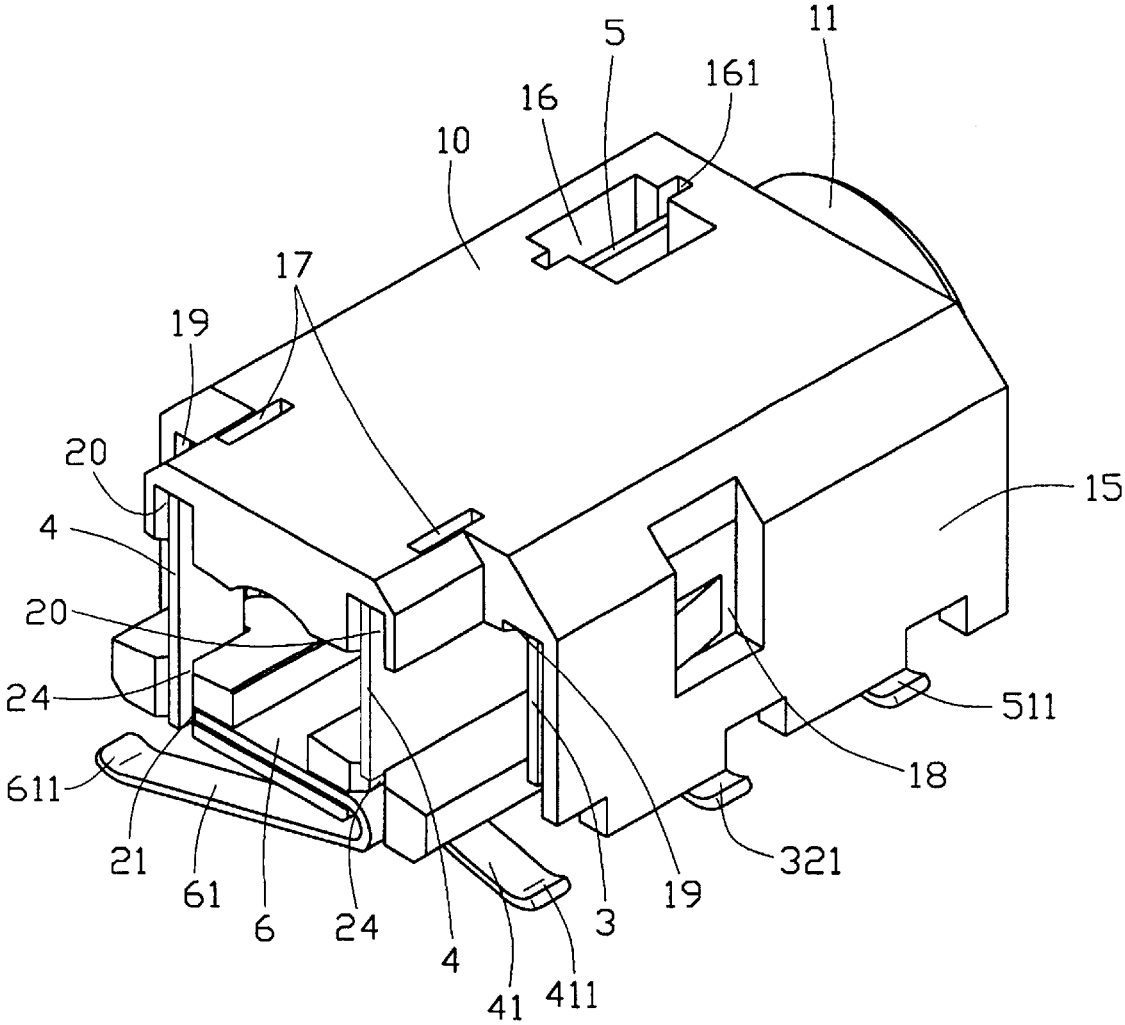
FIG. 3 is an assembled view of the audio jack of FIG. 1.
Figure 5:
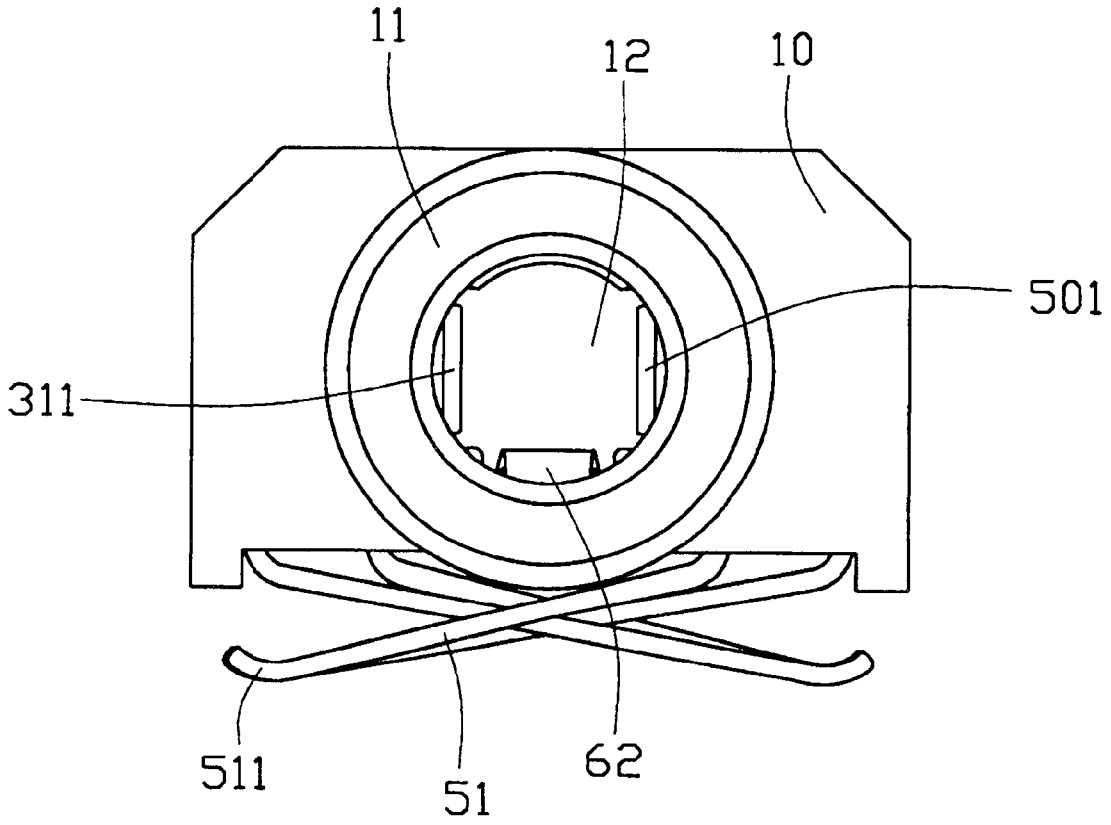
FIG. 5 is a front view of FIG. 3.

In assembly, with reference to FIGS. 3, 4 and 5, the resilient contacts 3 are fixed in the channels 19, the protrusions 301 latching with the corresponding openings 18 for retaining the resilient contacts 3 in the housing 1. The curve portions 311 project into the plug-insertion hole 12. The tail portions 32 respectively extend downwardly and inwardly out of the housing 1.

Each switch contact 4 is mounted in both a corresponding upper notch 20 and lower notch 24 and contacts the contact portion 312 of the corresponding resilient contact 3 when the plug is not inserted into the housing 1 (shown in FIG. 1). The barb 42 of each switch contact 4 is respectively retained in the corresponding slit 17. The tail portions 41 each extend downwardly and inwardly out of the housing 1.

The retention pad 5 is fixedly retained in the slot 16. The barbs 52 of the retention pad 5 are respectively retained in the corresponding cutouts 161 of the slot 16. The tail portion 51 extends downwardly and inwardly out of the housing 1.

The grounding contact 6 is fixed in the trough 21 and the contacting protrusion 62 of the grounding contact 6 projects into the plug-insertion hole 12. The tail portion 61 extends downwardly and inwardly out of the housing 1.

The contact tabs 321, 411, 511 and 611 of the tail portions 32, 41, 51 and 61 substantially lie in a common plane.

When the plug is inserted into the housing 1 the plug pushes curve portions 311 sideways and the contact portion 312 of each resilient contact 3 is deflected to move away from the corresponding switch contact 4, thereby breaking an electrical connection therebetween. The curve portion 311 of each resilient contact 3 contacts a corresponding constituent electrode of the plug to establish an electrical connection between the plug and the audio jack. At the same time, the contacting protrusion 62 of the grounding contact 6 and the protrusion 501 of the retention pad 5 bear against the plug. The protrusion 501 of the retention pad 5 abuts against the plug with a predetermined force. Preferably, the protrusion 501 of the retention pad 5 applies just enough force against the plug to protect the resilient contacts 3 from being overstrained by the forces exerted against them by the plug. Thus, permanent distortion of the resilient contacts 3 can be avoided. The height of the protrusion 501 of the retention pad 5 measured with respect to the base 50 can be adjusted during its manufacture by, for example, precision stamping to meet requisite criteria.

In use, the audio jack is retained between the circuit board and a fixed portion of an electronic device, for example, a casing of a mobile phone. By wedging the audio jack between the circuit board and a portion of the electronic device, the audio jack is downwardly pressed slightly and the contact tabs 321, 411, 511 and 611 resiliently engage with appropriate circuit traces on the top surface of the printed circuit board. In this way, the audio jack is maintained in position on the circuit board without requiring soldering of the contacts to the circuit traces.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An audio jack, comprising:

an insulative housing defining a longitudinal plug-insertion hole therethrough for receiving a mating plug; and a plurality of contacts fixed in the housing, each contact including a base, a tail portion downwardly and inwardly extending from the base, and a contact tab formed on a distal end of each tail portion for resiliently abutting against appropriate circuit traces of a printed circuit board;

further comprising a retention pad, the retention pad including a base retained in the housing, a protrusion formed on the base for pressing against an inserted plug, and a tail portion downwardly and inwardly extending from the base, and wherein a slot is defined in an inner sidewall of the housing for receiving the retention pad;

wherein the base of the retention pad forms a pair of barbs on two opposite edges thereof, and wherein the slot comprises a pair of cutouts for latching with the barbs;

wherein the contacts comprise two resilient contacts, each resilient contact including a cantilevered spring contact arm bending and reversely extending from an end of the base, and wherein the housing defines longitudinal channels in an inner sidewall thereof for receiving the resilient contacts;

wherein the base of each resilient contact forms a protrusion, and wherein the housing defines openings through the sidewall thereof for receiving the protrusions;

wherein each cantilevered spring contact arm has a curved portion projecting into the plug-insertion hole and a contact portion at a free end of the curve portion;

wherein the contacts comprise two switch contacts, the base of each switch contact being provided to cooperate with the contact portion of the corresponding resilient contact for switching, and wherein the housing respectively defines upper notches in a top wall thereof, and lower notches in a bottom thereof and aligned with the upper notches for receiving the switch contacts;

wherein the base of each switch contact forms a barb on the upper side thereof, and wherein the housing defines a slit in the top wall thereof for latching with the barb;

wherein the contacts comprise a grounding contact, and wherein the housing upwardly defines a trough in a bottom thereof for receiving the grounding contact;

wherein a contacting protrusion is upwardly convex at an end of a base of the grounding contact for contacting the plug;

wherein each of the contacts and the retention pad include respectively contact tabs extending obliquely downwardly around a bottom portion of the housing, and wherein three of said contact tabs extend from a left side of the housing toward the right side of the housing while the other three of said contact tabs extend from the right side of the housing to the left side of the housing, said three contact tabs and said other three contact tabs being alternately arranged with each other.

* * * * *